US005842343A

United States Patent [19]

Frey

[11] Patent Number: 5,842,343

[45] Date of Patent: Dec. 1, 1998

[54] HYDRAULIC AXIAL DISCHARGE PUMP

[75] Inventor: Bernhard Frey, Schaffhausen, Switzerland

[73] Assignee: Hydrowatt Systems Ltd., London, United Kingdom

[21] Appl. No.: 715,735

[22] Filed: Sep. 19, 1996

Related U.S. Application Data

[63] Continuation-in-part of Ser. No. 414,128, Mar. 30, 1995, abandoned, which is a continuation of Ser. No. 101,308, Aug. 3, 1993, abandoned.

[30] Foreign Application Priority Data

Aug. 6, 1992 [CH] Switzerland ..... 2566/92

[51] Int. Cl.[6] ..... F16D 31/02

[52] U.S. Cl. ..... 60/486; 72/153; 417/372; 417/205

[58] Field of Search ..... 92/153; 60/486, 60/488; 417/205, 372

[56] References Cited

U.S. PATENT DOCUMENTS

| | | | |
|---|---|---|---|
| 2,408,716 | 10/1946 | Witchger | 417/372 |
| 2,845,029 | 7/1958 | Gratzmuller | 92/153 |
| 3,092,307 | 6/1963 | Heidorn | 92/153 |
| 4,041,703 | 8/1977 | Knapp | 60/486 |
| 4,188,859 | 2/1980 | Van Wagenen et al. | 91/499 |
| 4,281,971 | 8/1981 | Kouns | 417/205 |

FOREIGN PATENT DOCUMENTS 60-174500 9/1985 Japan .

OTHER PUBLICATIONS

BACKE, "Grundlagen der Oelhydraulik" (Fundamentals of Oil Hydraulics), Institut für Hydraulische und pneumatische Antriebe und Steuerungen der Rheinisch–Westfälischen Technischen Hochschule Aachen, 2nd edition, 1974, p. 116, with illustrations 4–22 to 4–25.

*Primary Examiner*—F. Daniel Lopez
*Attorney, Agent, or Firm*—Greenblum & Bernstein, P.L.C.

[57] ABSTRACT

A hydraulic axial piston machine, such as a high-pressure water discharge pump, may include a first subassembly having a plurality of cylinder-piston units arranged at a distance from, and either parallel to or at an acute angle to, a central axis. The cylinder-piston units may be circumferentially offset, relative to each other, around the central axis by a predetermined angle. The hydraulic axial discharge pump may also include a second subassembly which may be coaxially positioned and arranged for rotation around the central axis on a drive shaft and which may have a force-transmitting connection with the cylinder-piston units to receive oscillating drive forces of the cylinder-piston units. The drive shaft, which may include at least two rotationally coupled longitudinal sections, may extend coaxially to the central axis from its drive input end through at least one of a corresponding central opening of the first subassembly and of the housing to a head-subassembly. The hydraulic axial piston machine may include a filler pump and a lubricant pump each coupled to separate sections of the drive shaft for providing a rotational drive connection. A flow path of the filler pump may be connected in series with a main flow path of the axial discharge pump to deliver substantially the entire admission flow to the hydraulic axial discharge pump at an enhanced hydraulic input pressure to the cylinder-piston units sufficient for avoiding cavitation.

6 Claims, 2 Drawing Sheets

HYDRAULIC AXIAL DISCHARGE PUMP

CROSS REFERENCE TO RELATED APPLICATIONS

This application is a Continuation-in-Part of U.S. patent application Ser. No. 08/414,128, filed Mar. 30,1995, now abandoned, which is a continuation of Ser. No. 08/101,308, filed Aug. 3, 1993, now abandoned, and claims the priority, under 35 U.S.C. § 119, of Swiss Patent Application No. 02 566/92-4, filed Aug. 6, 1992, the disclosures of each of these documents are expressly incorporated herein by reference in their entireties.

BACKGROUND OF THE INVENTION

1. Field of the Invention

The invention pertains to a hydraulic axial discharge pump, in particular a high-pressure water discharge pump of the type having a first subassembly, including a plurality of circumferentially-spaced cylinder-piston units around a central axis; a second subassembly rotatably connected with the first assembly in a force-transmitting manner with the cylinder piston units in a coupling plane arranged at a predetermined angle to the central axis, wherein one of these subassemblies is rotatably arranged within a housing and coupled with rotational drive means.

2. Discussion of the Background of the Invention and Material Information

Different types of such axial piston machines, namely "swash-plate machines", "skew-plate machines" and "skew-drum machines" are known in the art, e.g. from printed lecture notes entitled "Grundlagen der Oelhydraulik" (Fundamentals of Oil Hydraulics), by Prof. W. Backe, Institut für hydraulische und pneumatische Antriebe und Steuerungen der Rheinisch-Westfälischen Technischen Hochschule Aachen, 2 nd edition 1974, p. 116, together with illustrations 4-22 to 4-25, which are incorporated herein by reference.

The genus of axial piston machines is subdivided into the following types:

I. swash-plate machines;

II. skew-plate machines; and

III. skew-drum machines.

Discharge pumps of these types, in particular type I, are deemed to be encompassed by this invention, wherein in a type I machine the first subassembly is represented by a cylinder-piston arrangement fixed in a housing, and the second subassembly is represented by a rotating swash-plate, with the second subassembly, therefore, being a drive subassembly.

In a type II machine the first subassembly is represented by a rotating drum containing a cylinder-piston arrangement, with this first subassembly thus being a drive subassembly, while the second subassembly is represented by a fixed skew-plate.

In a type III machine the first subassembly again is represented by a rotating drum, containing a cylinder-piston arrangement, while the second subassembly is represented by a rotating drive plate arranged perpendicular to its axis of rotation. The rotational axes of both subassemblies are arranged at an angle relative to each other. In this embodiment the second subassembly is the drive subassembly. Substantially no drive torque is transferred to the first subassembly.

More specifically, a relevant part of the background of the present invention is shown in U.S. Pat. No. 4,041,703. The machine shown is a combination of a hydraulic axial piston pump and a hydraulic axial piston motor, both connected in a closed hydraulic loop with feed and runback (return) conduits. Under normal conditions, there is no discharge of fluid other than minimum leakage. Accordingly, the whole machine is a drive system, typically in oil hydraulic techniques. Further, there is an auxiliary charge pump in order to compensate leakage and maintain the necessary low pressure at the pump runback feed. Thus, the charge pump shown has only minimum flow rate and pressurizing functions and capacity.

SUMMARY OF THE INVENTION

With reference to the above discussion of the relevant prior art, a first objective of the present invention is to improve the input and filling conditions at the hydraulic axial discharge pump in view of a filler pump provided there. In this context, it is noted that flow rate and pressurizing functions at the input of such discharge pumps is fundamentally different from leakage compensation at the input of a drive pump in a closed loop flow system.

Therefore, one aspect of the present invention may be directed to a hydraulic axial discharge pump, e.g., a high-pressure water discharge pump. The hydraulic axial discharge pump may include a first subassembly having a plurality of cylinder-piston units. The cylinder-piston units may be arranged at a distance from, and in one of being parallel to and being at an acute angle to, a central axis and may be circumferentially offset, relative to each other around the central axis by a predetermined angle. The hydraulic axial discharge pump may also include a second subassembly which may be coaxially positioned and arranged for rotation around the central axis on a drive shaft. The second subassembly may also have a force-transmitting connection with the cylinder-piston units to receive oscillating drive forces of the cylinder-piston units. The drive shaft, which may include at least two rotationally coupled longitudinal sections, may extend coaxially to the central axis from its drive input end through at least one of a corresponding central opening of the first subassembly and of the housing to a head-subassembly. The head-subassembly may include a filler pump coupled with the drive shaft. A flow path of the filler pump may be connected in series with a main flow path of an axial discharge pump to deliver substantially the entire admission flow to the hydraulic axial discharge pump at an enhanced hydraulic input pressure to the cylinder-piston units sufficient for avoiding cavitation.

The above-noted features facilitate maintaining proper input pressure and filling the discharge pump with its great flow rates, which should pass the filler pump. To a substantial extent, this effect is due to the arrangement of the filler pump being in series with the main flow and being closely adjacent to the input valve assembly of the discharge pump. A further desirable effect is the short flow distance therebetween as well as comparatively great flow cross-sections to be realized easily, which minimizes the danger of resonance pressure pulsations in the fluid, which is usually followed by cavitation and operation failure. Another advantage is a comparatively narrow and space-saving structure due to coupling of the filler pump with a section of the drive shaft extending just to the input valve assembly.

Another objective of the present invention is to improve the lubricant supply to the cylinder-piston units. Accordingly, another feature of the present invention may be directed to a hydraulic axial discharge pump, e.g., a high-pressure water discharge pump, including a first subassembly having a plurality of cylinder-piston units. The cylinder-piston units may be arranged at a distance from, and in one of being parallel to and being at an acute angle to, a central axis and may be circumferentially offset, relative to each other around the central axis by a predetermined angle. The hydraulic axial discharge pump may also include a second subassembly which may be positioned coaxially with and arranged for rotation around the central axis on a drive shaft. The second subassembly may also have a force-transmitting connection with the cylinder-piston units to receive oscillating drive forces of the cylinder-piston units. The drive shaft, which may include at least two rotationally coupled longitudinal sections, may extend coaxially to the central axis from its drive input end through at least one of a corresponding central opening of the first subassembly and of the housing respectively. The first subassembly may include a lubricant system to be situated in the range of the central axis and at least in part within in the radial space between the cylinder-piston units to extend over an axial length which is covered at least in part by the axial length of the cylinder-piston units.

These above features facilitate a steady and vibration free lubricant supply to the pistons with their regularly critical sliding conditions. This desired effect is primarily due to the short flow distances between the lubricant source and the sliding elements of the pistons. Thus, according to another feature of the present invention, the lubricant system may be connected through at least one substantially radially extending lubricant channel to at least one of the cylinder-piston units. According to yet another feature of the present invention the lubricant system may include a lubricant pump arranged on the longitudinal section of the drive shaft and in a rotational drive connection therewith.

Finally, a further extension of the objective of the invention is directed to improvements of axial piston machines, particularly type I machines, with regard to a desired structural combination of machine parts that come into contact with the hydraulic working medium, which is often dangerous or corrosive, and with regard to offering easy access to valves, auxiliary units and the like for service and repair. The solution to this objective is defined by an axial piston machine including a plurality of cylinder-piston units which are arranged at a distance from and parallel to or at an acute angle to a central axis as well as being circumferentially offset relative to each other around the central axis by a predetermined angle; a second subassembly being coaxially with and located rotationally around the central axis on a drive shaft, the second subassembly further having a force-transmitting connection with the cylinder-piston units so as to receive the oscillating drive forces of the cylinder-piston units; wherein the drive shaft, which preferably includes at least two rotationally coupled longitudinal sections, extending coaxially with the central axis from its drive input end through a corresponding central opening of the first subassembly or of the housing respectively, to a head-subassembly which includes at least one auxiliary unit coupled with the drive shaft.

Accordingly, valves, auxiliary units and the like, can be positioned in a comparatively freely accessible head-subassembly. A special advantage of such a design is that the pistons, located in the first subassembly and connected thereto, are also easy accessible.

Preferably the head-subassembly includes a feed pump coupled with the drive shaft and/or a pump or motor valve assembly. A further advantage made possible by the subject design is restricting the use of corrosion resistant materials to the head-subassembly.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

Figure 1:
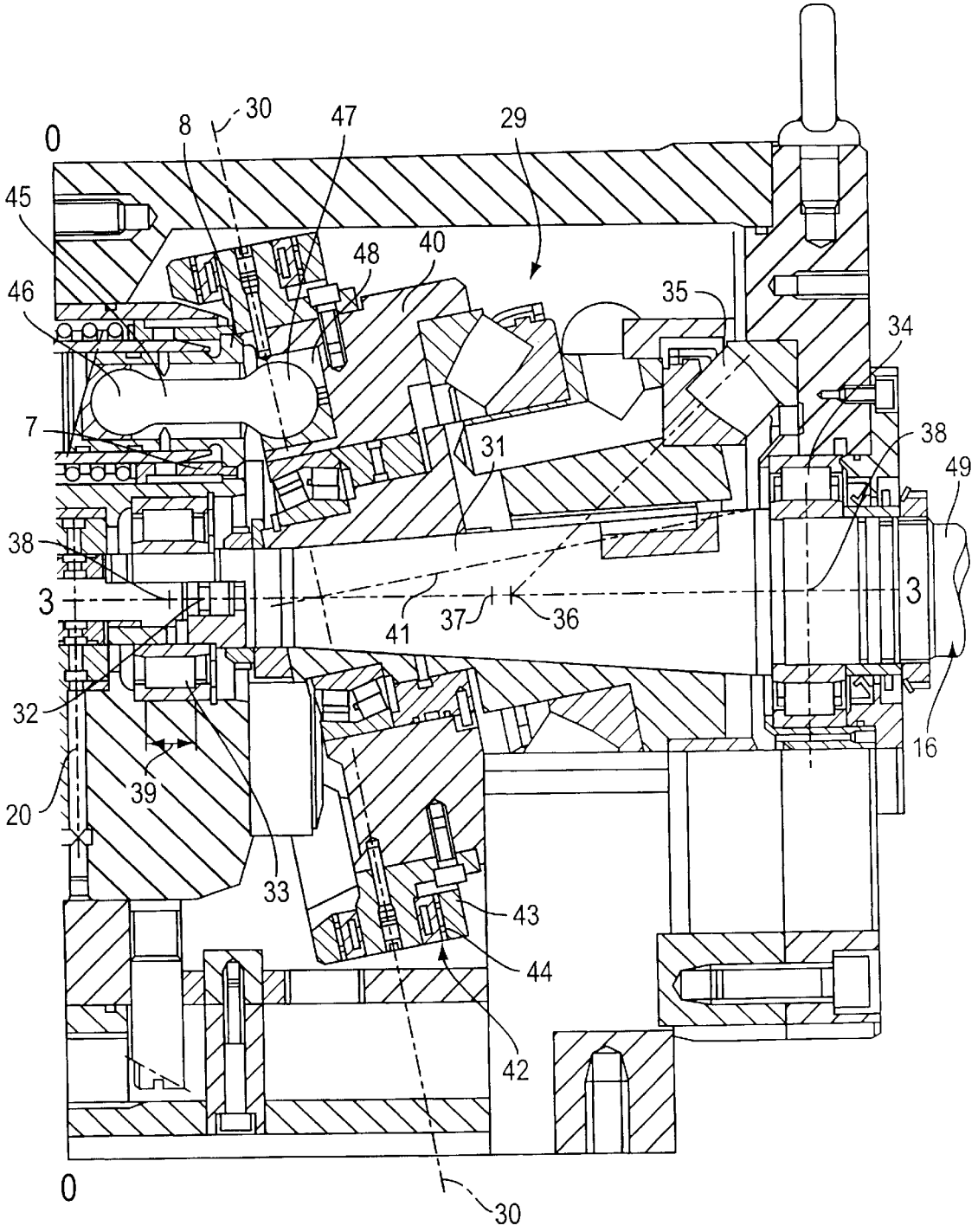
FIG. 1 is an axial section of a portion of a type I axial piston pump.

The invention will now be described in detail with reference to the example of a type I swash-plate axial piston pump illustrated in the drawings. It should also be understood that all the features of the invention can be constructed with reference to the illustrated embodiment, with particular reference to the previously-noted type II and III machines.

Figure 2:
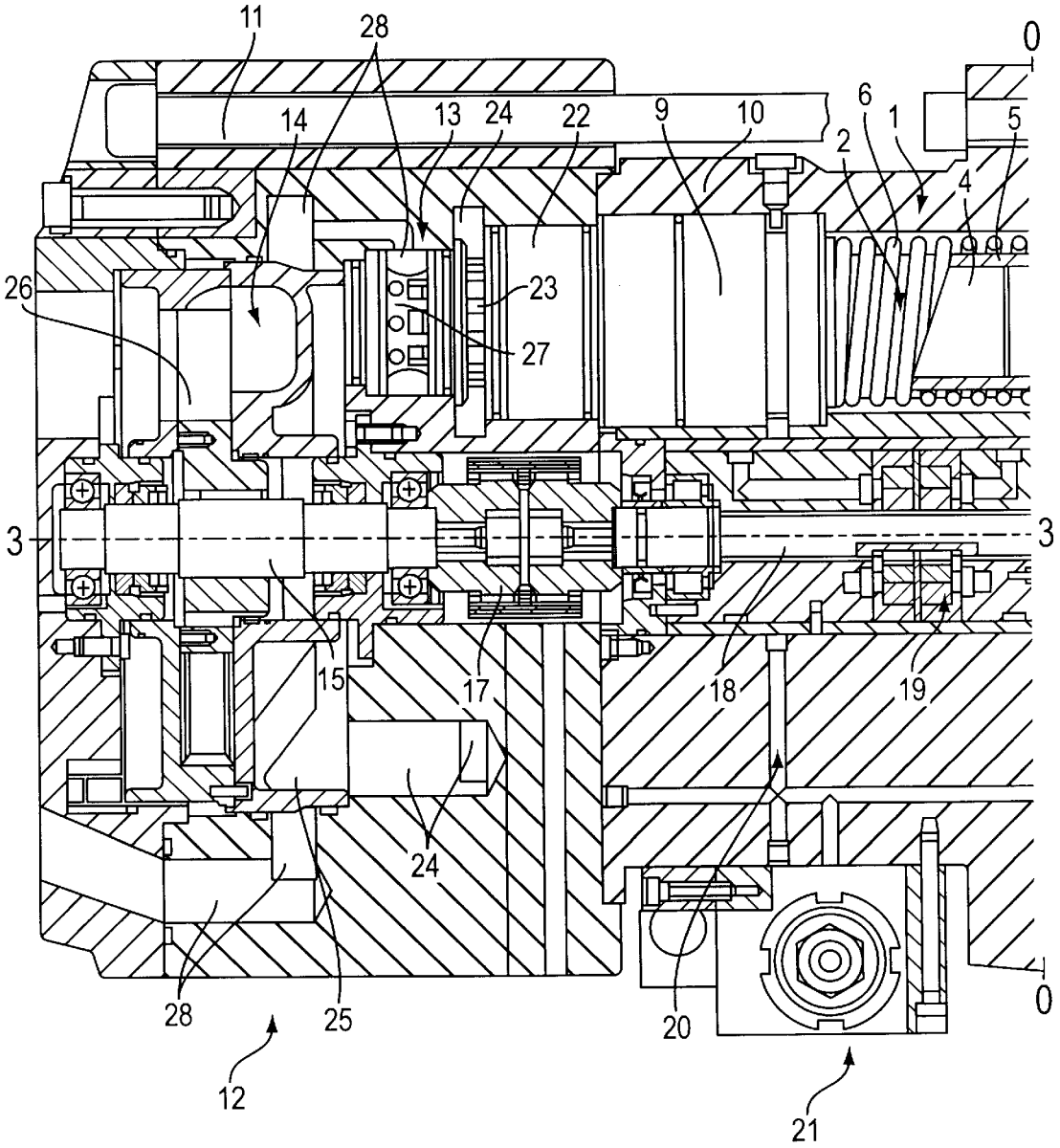
FIG. 2 is an axial section of a further portion of the type I axial piston pump of FIG. 1, with FIGS. 1 and 2 showing two axially adjacent parts of this pump. The common radial plane of the two adjacent pump portions is identified by lines 0—0.

Specifically, in FIG. 2, a first subassembly 1 is comprised of a plurality of, for example five, cylinder-piston units 2, which units are arranged at a radial distance from and parallel to a central longitudinal axis 3 as well as being circumferentially offset, relative to each other around the central axis by an appropriate angle, for example 72°. Each cylinder-piston unit is comprised of a piston 4 slidably arranged in a cylinder 5 with piston 4 and cylinder 5 being shown in axial sections only over a part of their axial length. Specific design details of cylinder 5 and piston 4 are only of minimal interest in the present context, since cylinder-piston units 2 may be of any type well known in the art.

A pretensioned return coil or compression spring 6 surrounds cylinder 5 and acts through a sleeve 7 against a radially projecting bottom flange 8 of piston 4, thus tending to push piston 4 in its restoring or cylinder-filling direction (in the Figures from the left to the right). The inner (in FIG. 2 the left) end of spring 6 abuts on the right end face of a support sleeve 9 fixedly retained in an axial bore of a machine housing 10. Support sleeve 9, on its right side, is fixedly secured to the left end portion of cylinder 5.

It should also be understood that, instead of an arrangement of cylinders 5 in parallel to axis 3, a design may be adopted with the cylinder axes being arranged at an acute angle, e.g. between 5° and 10°, relative to axis 3. This may be advantageous in view of the space available between the cylinders for auxiliary elements or units.

The left end face of housing 10 is tightly connected, e.g. by means of highly pretensioned axial screws 11, with a head-subassembly 12, which among other parts houses a valve assembly 13 and a filler or feed pump 14 attached to a section 15 of a drive shaft 16 (FIG. 1). Drive shaft section 15 is coupled, by means of a toothed-clutch 17, to a central drive shaft section 18. Filler pump 14 serves to enhance the input hydraulic pressure for the cylinder-piston units 2 to a value sufficient for avoiding cavitation. Filler pump 14 may be axially situated in front of valve assembly 13.

Drive shaft section 18 may also drive a lubricant pump 19, which in turn may feed a lubricant channel system 20 via a lubricant filter 21. The lubricant system, which may include lubricant pump 19, the lubricant channel system 20, and lubricant filter 21, may be at least partially positioned within the radial space between cylinder-piston units 2 and may extend along central axis 3 to include at least a portion of the axial length of the cylinder-piston units 2. The short flow distances between a lubricant source and the sliding elements of piston 4 provides a steady and vibration free lubricant supply to the pistons so that their regularly critical sliding conditions may be maintained. For example, the lubricant source may be connected through at least one substantially radially extending lubricant channel to at least one of the cylinder-piston units 2. Lubricant pump 19 may be arranged on a longitudinal section of the drive shaft 16, e.g., at central drive shaft 18, for rotational drive connection.

Lubricant pump 19 and filler pump 14 may be arranged on separate sections of drive shaft 16. Each pump may include a respective rotational drive connection. For example, lubricant pump 19 and filler pump 14 may be coaxially coupled to separate drive shaft sections, e.g., 18 and 15, respectively, for rotationally driving each respective pump.

Coaxially attached to each cylinder-piston unit 2 is a combined inlet-outlet valve 22 having an inlet side 23 connected, via in inlet channel system 24, to the output 25 of filler pump 14. Pump 14, for example, may be a well-known "side-channel" type pump, the details of which will not be described here since it is not material for the essence or function of the invention. Filler pump 14 may be connected, via an input 26, to a non-illustrated external low-pressure hydraulic feed system. Inlet/outlet valve 22 further has an output side 27, connected through an output channel system 28, to a non-illustrated external high-pressure hydraulic system. Valve 22 has substantially coaxial internal flow channel systems and spring-loaded check valve members for both flow directions, i.e. to and from the corresponding cylinder-piston unit 2. The internal structure of valve 22 is of no specific interest for the invention and thus will not be described in further detail. In principle, instead of the noted example of the combined inlet/outlet valve 22 described here, other conventional and well-known valve types may be used.

In FIG. 1, a second subassembly 29 is rotatably arranged relative to first subassembly 1. Subassembly 29 is in force-transmitting connection with cylinder-piston units 2 within the range of a coupling plane 30, arranged at least approximately right-angled or perpendicular to the central longitudinal axis 3, so as to absorb the oscillating drive forces produced by cylinder-piston units 2. Subassembly 29 is constructed as a driving subassembly that is rotatably arranged in housing 10 and coupled with a main section 31 of drive shaft 16. Drive shaft sections 18 and 31 are coupled by means of any type of a conventional clutch.

It should also be mentioned that different design modes or types of subassembly 29 may be utilized. Thus, cylinder-piston subassembly 2 may be designed as a rotating drum, i.e. in the sense of previously-noted machine types II and III. In the latter case, this subassembly would be a substantially torqueless rotating unit.

Driving subassembly 29 includes a bearing assembly comprising two first bearings 33, 34, which act at least substantially in the radial direction and are arranged at a predetermined axial distance or spacing from each other, and a swivel-joint or pivot-type second bearing 35 acting both axially and radially. In the noted example, bearings 33 and 34 may take the form of axially movably cylindrical roller bearings, while bearing 35 may be a mainly axially acting spherical roller bearing.

The swivel or pivot center 36 of second bearing 35 is located at about the axial mid-point (center-to-center distance) 37 between the mid-points 38, of the bearing axial width 39, of axially spaced first bearings 33, 34.

Subassemblies 1 and 29 are arranged so as to be rotatable, in relation to each other, around their common central axis 3. Only one of these subassemblies, here subassembly 29, is arranged to be rotatable in housing 10 and functions as a driving subassembly, coupled with the drive shaft 16. However, as already noted earlier, a design according to machine type III may also be utilized.

In addition, a disk-like coupling member 40 is rotatably connected to second subassembly 29 around a swash axis 41, which is arranged at an angle relative to the central axis 3. Coupling member 40 is further connected to first subassembly 1 in a manner so as to be blocked against continuous rotation around central axis 3, and is connected in a force-transmitting manner with the cylinder-piston units 2 within the range of coupling plane 30. Coupling plane 30 is arranged at least approximately right-angled or perpendicularly to swash axis 41. Thus, coupling member 40 takes over or absorbs the substantially axial, oscillating drive forces produced by cylinder-piston units 2 and transmits such forces to second subassembly 29. It should be understood that coupling member 40 can also be regarded as a part of second subassembly 29.

The noted rotation-blocking connection between coupling member 40 and first subassembly 1 is accomplished by means of a positively-acting holding device 42. In the illustrated embodiment, holding device 42 is a cardan type of device comprising a cardan ring 43, which extends along the external perimeter of coupling member 40 and which is connected with each of coupling members 40 and subassembly 1 by means of a pair of diametrical pivots 44. In view of first subassembly 1 being fixedly arranged in machine housing 10, cardan ring 43 is fixed to housing 10 by means of a further pair of non-illustrated diametrical pivots. In the illustrated embodiment, double-jointed rods 45, preferably double ball-jointed rods, are provided for the force transmission between cylinder-piston units 2 and coupling member 40. Each of double-jointed rods 45 is connected by means of a first joint 46 to a corresponding piston 2 and by means of a second joint 47 to a corresponding junction assembly 48 of coupling member 40.

As already previously noted, in the illustrated embodiment, drive shaft 16 is comprised of three rotationally coupled sections 31, 18 and 15. Drive shaft 16 extends coaxially with central axis 3 from its drive input end 49 through a corresponding central opening of first subassembly 1 and of housing 10 to head-subassembly 12 with feed pump 14 and valve assembly 13.

A flow path of filler pump 14 may be connected in series with a main flow path of the hydraulic axial discharge pump to deliver substantially the entire admission flow at an enhanced hydraulic input pressure to the cylinder-piston units sufficient for avoiding cavitation. Head-subassembly 12 may include the inlet/outlet valve (an input valve assembly) 22 coupled to the hydraulic axial discharge pump and filler pump 14 may be arranged with at least one output port 25 coupled to input valve assembly 22 through inlet channel system 24 of the hydraulic discharge pump (main pump). Further, the filler pump may be a "side channel" type device and may be arranged with its side channel and at least one output port, e.g., output 25, adjacent to input valve assembly 22.

Obviously, the mode of design according to the invention, as specifically depicted in the illustrated embodiment, can also be utilized for axial piston motors. Of course, the valve assembly then must be positively coupled to and synchronized with the rotation of the drive shaft, which then functions as a power output shaft.

While there are shown and described present preferred embodiments of the invention, it is to be distinctly understood that the invention is not limited thereto, but may be otherwise variously embodied and practiced within the scope of the following claims and the reasonably equivalent structures thereto.

In particular, it is to be understood that the angle between the swash axis and the central axis may be predetermined so as to be a fixed acute angle value or to be variably adjustable in operation between 0° and a predetermined maximum acute angle, and with an angle variation to both sides of the zero angle value, if desired, for purposes of hydraulic flow direction reversal. Such variation obviously entails a corresponding variation of the angle between the coupling plane and the central axis, which is the complementary angle to the one between the swash axis and the central axis and the determinative for the magnitude of the piston stroke. This type of swash plate axial piston machine with variable swash-angle is well known in the art. Thus, the realization of the subject of the present invention for such variable swash angle machines may be established by usual structures near at hand and requires no further explanation.

What is claimed is:

1. A hydraulic axial discharge pump, comprising:

a) a housing;

b) a first subassembly within said housing including a plurality of cylinder-piston units, said cylinder-piston units being arranged at a distance from, and in one of being parallel to and being at an acute angle to, a central axis and being circumferentially offset, relative to each other, around said central axis by a predetermined angle;

c) a second subassembly being coaxially positioned and arranged for rotation around said central axis on a drive shaft, said second subassembly further having a force-transmitting connection with said cylinder-piston units so as to receive oscillating drive forces of said cylinder-piston units;

d) said drive shaft, including at least two rotationally coupled longitudinal sections, coaxially extending along said central axis from a drive input end and through a corresponding central opening of at least one of said first subassembly and of said housing;

e) said first subassembly including a lubricant system being positioned in a vicinity of said central axis and at least partially within a radial space between said cylinder-piston units, and to extend over an axial length which is covered at least partially by an axial length of said cylinder-piston units;

f) said lubricant system including a lubricant pump being arranged on one of said at least two rotationally coupled longitudinal sections of said drive shaft and in a rotational drive connection therewith; and g) a head-subassembly including a filler pump coupled with said drive shaft, a flow path of said filler pump being connected in series with a main flow path of the hydraulic axial discharge pump to deliver substantially an entire admission flow at an enhanced hydraulic input pressure to said cylinder-piston units sufficient for avoiding cavitation.

2. The hydraulic axial discharge pump of claim 1, wherein said head-subassembly further includes an input valve assembly coupled to the hydraulic axial discharge pump and wherein said filler pump is arranged with at least one output port adjacent to said input valve assembly.

3. The hydraulic axial discharge pump of claim 1, wherein said head-subassembly further includes an input valve assembly coupled to the hydraulic axial discharge pump, said filler pump being a side channel type and arranged with a side channel and at least one output port adjacent to said input valve assembly.

4. The hydraulic axial discharge pump of claim 1, wherein said lubricant pump and said filler pump are arranged on separate ones of said at least two rotationally coupled longitudinal sections of said drive shaft, each with a rotational drive connection, said separate drive shaft sections being coaxially arranged and coupled in drive connection with each other, said head-subassembly including an input valve assembly to the hydraulic axial discharge pump and wherein said filler pump is axially positioned in front of said input valve assembly.

5. A hydraulic axial high pressure discharge pump, comprising:

a) a housing;

b) a first subassembly within said housing including a plurality of cylinder-piston units, said cylinder-piston units being arranged at a distance from, and one of being parallel to and being at an acute angle to, a central axis as well as being circumferentially offset, relative to each other around said central axis by a predetermined angle;

c) a second subassembly being coaxial with and arranged rotationally around said central axis on a drive shaft, said second subassembly further having a force-transmitting connection with said cylinder-piston units so as to receive oscillating drive forces of said cylinder-piston units;

d) said drive shaft extending coaxially to said central axis from its drive input end through at least one central opening of said first subassembly and of said housing respectively;

e) said first subassembly including a lubricant system being positioned in a vicinity of said central axis and at least in part within a radial space between said cylinder-piston units so as to extend over an axial length which is covered at least in part by an axial length of said cylinder-piston units; and f) said lubricant system including a lubricant pump which is in a drive connection with said drive shaft and has a lubricant output connected through an output comprising at least one substantially radially extending lubricant channel to at least one of said cylinder-piston units so as to provide a steady and substantially vibration free lubricant supply to at least one piston of said cylinder-piston units.

6. The hydraulic axial discharge pump of claim 5, wherein said drive shaft includes at least two rotationally coupled longitudinal sections, and wherein said lubricant pump is arranged on one of said at least two rotationally coupled longitudinal sections of said drive shaft and in a rotational drive connection therewith.

* * * * *